US005507939A

United States Patent [19]

Russ et al.

[11] Patent Number: 5,507,939

[45] **Date of Patent: *Apr. 16, 1996**

[54] CATALYTIC REFORMING PROCESS WITH SULFUR PRECLUSION

[75] Inventors: Michael B. Russ, Villa Park; Frank R. Whitsura, Schaumburg; Roger L. Peer, WestChester; Joseph Zmich, Hanover Park; Chi-Chu D. Low, Lisle, all of Ill.

[73] Assignee: UOP, Des Plaines, Ill.

[ * ] Notice: The term of this patent shall not extend beyond the expiration date of Pat. No. 5,211,837.

[21] Appl. No.: 303,265

[22] Filed: Sep. 8, 1994

Related U.S. Application Data

[63] Continuation-in-part of Ser. No. 63,284, May 18, 1993, Pat. No. 5,366,614, which is a continuation-in-part of Ser. No. 842,835, Feb. 27, 1992, Pat. No. 5,211,837, which is a continuation-in-part of Ser. No. 555,962, Jul. 20, 1990, abandoned, which is a continuation-in-part of Ser. No. 408,577, Sep. 18, 1993, abandoned.

[51] Int. Cl.[6] ..... C10G 35/06; C10G 25/00

[52] U.S. Cl. ..... 208/65; 208/91; 208/99; 208/134; 208/138; 208/249; 208/299

[58] Field of Search ..... 208/65, 91, 99, 208/134, 138, 249, 299

[56] References Cited

U.S. PATENT DOCUMENTS

| | | | |
|---|---|---|---|
| 2,618,586 | 3/1950 | Hendel | 208/243 |
| 3,063,936 | 11/1962 | Pearce et al. | 208/211 |
| 3,898,153 | 8/1975 | Louder et al. | 208/91 |
| 4,225,417 | 9/1980 | Nelson | 208/89 |
| 4,329,220 | 5/1982 | Nelson | 208/89 |
| 4,456,527 | 6/1984 | Buss et al. | 208/89 |
| 4,534,943 | 8/1985 | Novak et al. | 422/188 |
| 4,575,415 | 3/1986 | Novak et al. | 208/91 |
| 4,634,515 | 1/1987 | Bailey et al. | 208/91 |
| 4,741,819 | 5/1988 | Robinson et al. | 208/65 |
| 4,831,206 | 3/1989 | Zarchy | 585/737 |
| 5,059,304 | 10/1991 | Field | 208/99 |
| 5,106,484 | 4/1992 | Nadler et al. | 208/91 |
| 5,211,837 | 5/1993 | Russ et al. | 208/65 |
| 5,300,211 | 4/1994 | Russ et al. | 208/65 |
| 5,322,615 | 6/1994 | Holtermann et al. | 208/91 |
| 5,366,614 | 11/1994 | Russ et al. | 208/65 |

*Primary Examiner*—E. Rollins Cross
*Assistant Examiner*—Walter D. Griffin
*Attorney, Agent, or Firm*—Thomas K. McBride; John F. Spears, Jr.; Richard E. Conser

[57] ABSTRACT

A hydrocarbon feedstock is catalytically reformed to effect dehydrocyclization of paraffins in a process combination comprising a first reforming zone, a sulfur-removal zone containing a mixed reforming catalyst and sulfur sorbent comprising a manganese component to preclude sulfur from the feed to a second reforming zone. The process combination shows substantial benefits over prior art processes in achieving reforming-catalyst stability.

20 Claims, 6 Drawing Sheets

CATALYTIC REFORMING PROCESS WITH SULFUR PRECLUSION

CROSS REFERENCE TO RELATED APPLICATION

This application is a continuation-in-part of prior application Ser. No. 08/063,284, filed May 18, 1993, U.S. Pat. No. 5,366,614, which is a continuation-in-part of Ser. No. 07/842,835, filed Feb. 27, 1992, U.S. Pat. No. 5,211,837, which is a continuation-in-part of Ser. No. 07/555,962, filed Jul. 20, 1990, abandoned, which is a continuation-in-part of Ser. No. 07/408,577, filed Sep. 18, 1989, abandoned, the contents of all of which are incorporated herein by reference thereto.

BACKGROUND OF THE INVENTION

1. Field of the Invention

This invention relates to an improved process for the conversion of hydrocarbons, and more specifically for the catalytic reforming of gasoline-range hydrocarbons.

2. General Background

The catalytic reforming of hydrocarbon feedstocks in the gasoline range is an important commercial process, practiced in nearly every significant petroleum refinery in the world to produce aromatic intermediates for the petrochemical industry or gasoline components with high resistance to engine knock. Demand for aromatics is growing more rapidly than the supply of feedstocks for aromatics production. Moreover, the widespread removal of lead antiknock additive from gasoline and the rising demands of high-performance internal-combustion engines are increasing the required knock resistance of the gasoline component as measured by gasoline "octane" number. The catalytic reforming unit therefore must operate more efficiently at higher severity in order to meet these increasing aromatics and gasoline-octane needs. This trend creates a need for more effective reforming processes and catalysts.

Catalytic reforming generally is applied to a feedstock rich in paraffinic and naphthenic hydrocarbons and is effected through diverse reactions: dehydrogenation of naphthenes to aromatics, dehydrocyclization of paraffins, isomerization of paraffins and naphthenes, dealkylation of alkylaromatics, hydrocracking of paraffins to light hydrocarbons, and formation of coke which is deposited on the catalyst. Increased aromatics and gasoline-octane needs have turned attention to the paraffindehydrocyclization reaction, which is less favored thermodynamically and kinetically in conventional reforming than other aromatization reactions. Considerable leverage exists for increasing desired product yields from catalytic reforming by promoting the dehydrocyclization reaction over the competing hydrocracking reaction while minimizing the formation of coke.

The effectiveness of reforming catalysts comprising a non-acidic L-zeolite and a platinum-group metal for dehydrocyclization of paraffins is well known in the art. The use of these reforming catalysts to produce aromatics from paraffinic raffinates as well as naphthas has been disclosed. The increased sensitivity of these selective catalysts to sulfur in the feed also is known. Nevertheless, commercialization of this dehydrocyclization technology has been slow in coming following an intense and lengthy development period. The extreme catalyst sulfur intolerance of current reforming catalysts selective for dehydrocyclization, providing surprising results when sulfur is precluded from the feed according to the process of the present invention, is only now being recognized.

RELATED ART

U.S. Pat. No. 2,618,586 (Hendel) discloses a process for removing relatively small amounts of sulfur-containing compounds from a petroleum liquid using an adsorbent which could be manganese oxide. U.S. Pat. No. 3,063,936 (Pearce et al.) discloses a desulfurization process combining sulfuric acid treatment, contact with a material which may be manganese oxide and contact with a hydrodesulfurization catalyst. However, neither Hendel nor Pearce et al. suggest the catalytic reforming process of the present invention.

U.S. Pat. No. 3,898,153 (Louder et al.) teaches a catalytic reforming process including chloride removal, hydrodesulfurization, and zinc oxide adsorbent to reduce the sulfur content of the reformer feed to as low as 0.2 ppm. U.S. Pat. No. 4,634,515 (Bailey et al.) discloses a nickel-catalyst sulfur trap downstream of a hydrofiner to reduce sulfur content to preferably below 0.1 ppm before a reforming unit. However, neither Louder et al. nor Bailey et al. contemplate the first reforming zone and manganese component precluding sulfur from the feed to a second reforming zone of the present invention.

U.S. Pat. Nos. 4,225,417 and 4,329,220 (Nelson) teach a reforming process in which sulfur is removed from a reforming feedstock using a manganese-containing composition. Preferably, the feed is hydrotreated and the sulfur content is reduced by the invention to below 0.1 ppm. U.S. Pat. Nos. 4,534,943 and 4,575,415 (Novak et al.) teach an apparatus and method, respectively, for removing residual sulfur from reformer feed using parallel absorbers for continuous operation; ideally, sulfur is removed to a level of below 0.1 ppm. Neither Nelson nor Novak et al., however, suggest the two reforming zones and resulting preclusion of feed sulfur to the second reforming zone of the present invention.

U.S. Pat. No. B1 4,456,527 (Buss et al.) discloses the reforming of a hydrocarbon feed having a sulfur content of as low as 50 ppb (parts per billion) with a catalyst comprising a large-pore zeolite and Group VIII metal. A broad range of sulfur-removal options are disclosed to reduce the sulfur content of the hydrocarbon feed to below 500 ppb. Removal of sulfur from a hydrotreated naphtha feedstock using a less-sulfursensitive reforming catalyst and a sulfur sorbent ahead of a highly sulfur-sensitive reforming catalyst, wherein the less-sulfur-sensitive reforming catalyst and sorbent can be layered in the same reactor, is taught in U.S. Pat. No. 4,741,819 (Robinson et al.). A combination of desulfurization with a platinum-on-alumina catalyst to avoid significant cracking and a sorbent comprising a supported Group I-A or II-A metal, wherein the catalyst and sorbent may be intermixed, is taught in U.S. Pat. No. 5,059,304. However, none of these references teach the reforming process combination of the present invention using a manganese component to preclude sulfur as elucidated hereinafter from the feed to a second reforming zone.

U.S. Pat. No. 4,831,206 (Zarchy) discloses a hydrocarbon conversion process comprising sulfur conversion, liquid-phase $H_2S$ removal with zeolite, and vaporization of the product to the reaction zone. Zarchy requires condensation and vaporization of the hydrocarbon stream, however, and does not teach the use of a manganese component to achieve the substantially sulfur-free effluent of the present invention.

Sequences of massive nickel/manganous oxide or massive nickel/activated alumina/manganous oxide for sulfur removal are disclosed in U.S. Pat. No. 5,106,484 (Nadler et al.), but the present process combination is not suggested.

SUMMARY OF THE INVENTION

Objects

It is an object of the present invention to provide a catalytic reforming process combination, effective for the dehydrocyclization of paraffins, with high catalyst stability. A corollary objective is to preclude sulfur from the feed to a reforming catalyst having unusual sulfur intolerance.

Summary

This invention is based on the discovery that a catalytic reforming process combination comprising a first reforming zone followed by an intermediate sulfur-removal zone using a physical mixture of a reforming catalyst and sulfur sorbent comprising a manganese component and a dehydrocyclization zone provides surprising paraffindehydrocyclization catalyst stability relative to the prior art.

Embodiments

A broad embodiment of the present invention is a catalytic reforming process combination in which a hydrocarbon feedstock contacts successively a first reforming catalyst in a first reforming zone, a mixture of a second reforming catalyst and sulfur sorbent in a sulfur-removal zone, and a dehydrocyclization catalyst containing L-zeolite and a platinum-group metal in a second reforming zone. Preferably the sulfur sorbent is a manganese component, especially one or more manganese oxides.

In a preferred embodiment, the second reforming and dehydrocyclization catalysts are the same catalyst. Optimally, an effluent from a sulfur-removal zone containing a physical mixture of the dehydrocyclization catalyst and manganese component contains no detectable sulfur.

An alternative embodiment of the present invention comprises one or more reactor vessels which contains both the physical mixture and the dehydrocyclization catalyst in a second reforming zone.

In another aspect, the process includes a precedent pretreating step using a nickel sorbent to remove most of the sulfur from the feedstock before it contacts the first reforming catalyst.

These as well as other objects and embodiments will become apparent from the detailed description of the invention.

DESCRIPTION OF THE PREFERRED EMBODIMENTS

To reiterate, a broad embodiment of the present invention is directed to a catalytic reforming process combination in which a hydrocarbon feed contacts successively a first reforming catalyst, a physical mixture of a reforming catalyst and sulfur sorbent, and a dehydrocyclization catalyst containing L-zeolite and a platinum-group metal.

Figure 1:
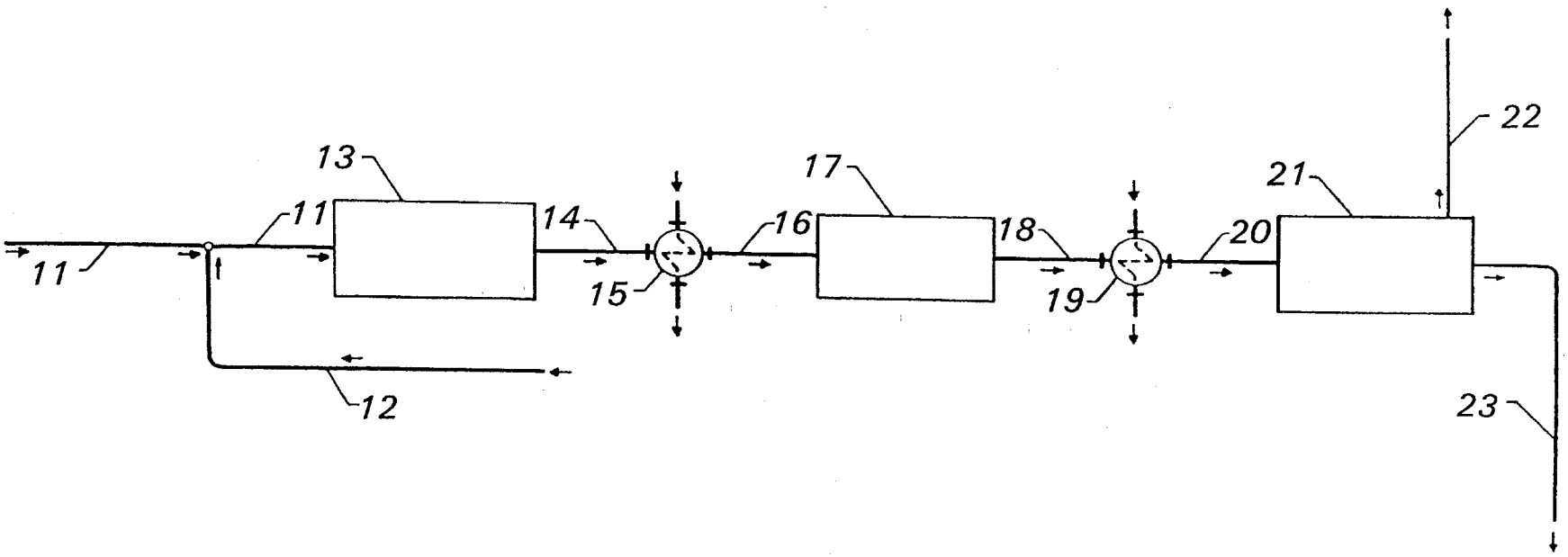
FIG. 1 is a simplified block flow diagram showing the arrangement of the major sections of the present invention.

FIG. 1 is a simplified block flow diagram representing the present invention. Only the major sections and interconnections of the process are represented. Individual equipment items such as reactors, heaters, heat exchangers, separators, fractionators, pumps, compressors and instruments are well known to those skilled in the art; description of this equipment is not necessary for an understanding of the invention or its underlying concepts.

The hydrocarbon feedstock is introduced to the process by line 11, and joins a hydrogen-containing stream from line 12 as combined feed to a first reforming zone 13. This zone contains the first reforming catalyst, described in more detail hereinafter, which converts substantially all of the sulfur in the feed to $H_2S$ while effecting reforming including dehydrocyclization and produces a first effluent via line 14. The temperature of the first effluent may be adjusted before sulfur removal, using heat exchanger 15, with the need for temperature adjustment depending on feedstock sulfur content and hydrocarbon types as discussed hereinafter. The first effluent, after the optional heat exchanger, passes via line 16 into a sulfur-removal zone 17. Sulfur entering this zone as $H_2S$ is removed from the process by conversion and sorption with a mixture of a second reforming catalyst and a manganese sulfur sorbent. A second effluent in line 18 is substantially sulfur-free. The temperature of the second effluent may be adjusted, using heat exchanger 19, before passing it via line 20 to a second reforming zone 21 in which paraffins are dehydrocyclized to aromatics. Net hydrogen-rich gas is produced and is removed via line 22 either as recycle to the process via line 12 or to other uses. The aromatics-rich effluent is removed as product in line 23.

The hydrocarbon feedstock comprises paraffins and naphthenes, and may comprise aromatics and small amounts of olefins, boiling within the gasoline range. Feedstocks which may be utilized include straight-run naphthas, natural gasoline, synthetic naphthas, thermal gasoline, catalytically cracked gasoline, partially reformed naphthas or raffinates from extraction of aromatics. The distillation range may be that of a full-range naphtha, having an initial boiling point typically from 40°–80° C. and a final boiling point of from about 160°–210° C., or it may represent a narrower range within a lower final boiling point. Light paraffinic feedstocks, such as naphthas from Middle East crudes having a final boiling point of from about 100°–160° C., are preferred due to the specific ability of the process to dehydrocyclize paraffins to aromatics. Raffinates from aromatics extraction, containing principally low-value $C_6$–$C_8$ paraffins which can be converted to valuable B-T-X aromatics, are especially preferred feedstocks.

The hydrocarbon feedstock to the present process contains small amounts of sulfur compounds, amounting to generally less than 10 parts per million (ppm) on an elemental basis. Preferably the hydrocarbon feedstock has been prepared from a contaminated feedstock by a conventional pretreating step such as hydrotreating, hydrorefining or hydrodesulfurization to convert such contaminants as sulfurous, nitrogenous and oxygenated compounds to $H_2S$, $NH_3$ and $H_2O$, respectively, which can be separated from the hydrotreated hydrocarbons by fractionation. This conversion preferably will employ a catalyst known to the art comprising an inorganic oxide support and metals selected from Groups VIB(6) and VIII(9–10) of the Periodic Table. [See Cotton and Wilkinson, *Advanced Organic Chemistry*, John Wiley & Sons (Fifth Edition, 1988)]. Good results are obtained with a catalyst containing from about 5 to 15 mass % molybdenum or tungsten and from about 2 to 5 mass % cobalt or nickel. Conventional hydrotreating conditions are sufficient to effect the needed degree of sulfur removal including a pressure of from about atmospheric to 100 atmospheres, a temperature of about 200° to 450° C., liquid hourly space velocity of from about 1 to 20, and hydrogen to hydrocarbon mole ratio of between about 0.1 and 10.

Alternatively or in addition to the conventional hydrotreating, the pretreating step may comprise contact with sorbents capable of removing sulfurous and other contaminants. These sorbents may include but are not limited to zinc oxide, iron sponge, high-surface-area sodium, high-surface-area alumina, activated carbons and molecular sieves. The art, including U.S. Pat. Nos. 4,028,223, 4,929,794, and 5,035,792 which are incorporated herein by reference, teaches that a nickel sorbent is effective for removing sulfur from hydrocarbons which subsequently are processed over a sulfur-sensitive catalyst. The nickel preferably is substantially in reduced form and is combined with an inert binder to provide a bed of particles; the nickel usually amounts to between 20 and 90 mass %, preferably 30 to 70 mass %, of the total sorbent composite on an elemental basis. Excellent results are obtained with a nickel-on-alumina sorbent, and alternative preferred binders comprise clay, kieselguhr, or silica. The nickel may be composited with the binder by any effective means to provide active bound nickel, such as coextrusion and impregnation. The composite of nickel and binder usually is calcined and reduced according to procedures known in the art. A sorbent pretreating step using the nickel sorbent generally is conducted in the liquid phase at between atmospheric and 50 atmospheres pressure and a temperature of between about 70° and 200° C., and optimally between 100° and 175° C. Liquid hourly space velocity can vary widely between about 2 and 50 depending on feed sulfur content, product sulfur and resulting sorbent utilization, desired run length and use of a single or parallel swing beds. Preferably, the pretreating step will provide the first reforming catalyst with a hydrocarbon feedstock having low sulfur levels disclosed in the prior art as desirable reforming feedstocks, e.g., 1 ppm to 0.1 ppm (100 ppb). It is within the ambit of the present invention that the pretreating step be included in the present reforming process.

Operating conditions used in the first reforming zone of the present invention include a pressure of from about atmospheric to 60 atmospheres (absolute), with the preferred range being from atmospheric to 20 atmospheres and a pressure of below 10 atmospheres being especially preferred. Hydrogen is supplied to the first reforming zone in an amount sufficient to correspond to a ratio of from about 0.1 to 10 moles of hydrogen per mole of hydrocarbon feedstock. The volume of the contained first reforming catalyst corresponds to a liquid hourly space velocity of from about 1 to 40 $hr^{-1}$. The operating temperature generally is in the range of 260° to 560° C. This temperature is selected to convert sulfur compounds in the feedstock to $H_2S$ in order to preclude sulfur from the second reforming zone. Operating temperature thus relates to feed sulfur content, difficulty of conversion of sulfur compounds, and other operating conditions in the first reforming zone. Hydrocarbon types in the feed stock also influence temperature selection, as naphthenes generally are dehydrogenated over the first reforming catalyst with a concomitant decline in temperature across the catalyst bed due to the endothermic heat of reaction. The temperature generally is slowly increased during each period of operation to compensate for the inevitable catalyst deactivation.

The first reforming catalyst contained in the first reforming zone preferably is a dual-function composite containing a metallic hydrogenation-dehydrogenation component on a refractory support which provides acid sites for cracking and isomerization. This catalyst functions principally to convert small amounts of sulfur in the feedstock, preferably about 0.05 to 2 ppm, to $H_2S$ in order to preclude sulfur from the feed to the second reforming catalyst. The first reforming catalyst would tolerate episodes of about 10 ppm of sulfur in the feedstock with substantial recovery of activity. The first reforming catalyst also preferably effects some dehydrogenation of naphthenes in the feedstock as well as, to a lesser degree, isomerization, cracking and dehydrocyclization.

The reforming catalyst comprises a platinum-group metal component and a refractory inorganic-oxide which can function as a support providing acid sites for cracking and isomerization or as a binder for a molecular-sieve component. This catalyst functions to convert small amounts of sulfur in the feedstock, preferably about 0.05 to 2 ppm, to $H_2S$ in order to preclude sulfur from the feed to the dehydrocyclization catalyst. The reforming catalyst also effects some dehydrogenation of naphthenes in the feedstock as well as isomerization, cracking and dehydrocyclization reactions.

The refractory support should be a porous, adsorptive, high-surface-area material which is uniform in composition without composition gradients of the species inherent to its composition. Within the scope of the present invention are refractory support containing one or more of: (1) refractory inorganic oxides such as alumina, silica, titania, magnesia, zirconia, chromia, thoria, boria or mixtures thereof; (2) synthetically prepared or naturally occurring clays and silicates, which may be acid-treated; (3) crystalline zeolitic aluminosilicates, either naturally occurring or synthetically prepared such as FAU, MEL, MFI, MOR, MTW (IUPAC Commission on Zeolite Nomenclature), in hydrogen form or in a form which has been exchanged with metal cations; (4) spinels such as $MgAl_2O_4$, $FeAl_2O_4$, $ZnAl_2O_4$, $CaAl_2O_4$; and (5) combinations of materials from one or more of these groups. The preferred refractory support for the reforming catalyst is alumina, with gamma- or eta-alumina being particularly preferred. Best results are obtained with "Ziegler alumina," described in U.S. Pat. No. 2,892,858 and presently available from the Vista Chemical Company under the trademark "Catapal" or from Condea Chemie GmbH under the trademark "Pural." Ziegler alumina is an extremely high-purity pseudoboehmite which, after calcination at a high temperature, has been shown to yield a high-priority gamma-alumina. It is especially preferred that the refractory inorganic oxide comprise substantially pure Ziegler alumina having an apparent bulk density of about 0.6 to 1 g/cc and a surface area of about 150 to 280 $m^2/g$ (especially 185 to 235 $m^2/g$) at a pore volume of 0.3 to 0.8 cc/g.

The inorganic oxide may be formed into any shape or form of carrier material known to those skilled in the art such as spheres, extrudates, rods, pills, pellets, tablets or granules. Spherical alumina particles may be formed by converting the alumina powder into alumina sol by reaction with suitable peptizing acid and water and dropping a mixture of the resulting sol and gelling agent into an oil bath to form spherical particles of an alumina gel, followed by known aging, drying and calcination steps.

An essential component of the reforming catalyst is one or more platinum-group metals, with a platinum component being preferred. The platinum may exist within the catalyst as a compound such as the oxide, sulfide, halide, or oxyhalide, in chemical combination with one or more other ingredients of the catalytic composite, or as an elemental metal. Best results are obtained when substantially all of the platinum exists in the catalytic composite in a reduced state. The platinum component generally comprises from about 0.01 to 2 mass % of the catalytic composite, preferably 0.05 to 1 mass %, calculated on an elemental basis. It is within the scope of the present invention that the catalyst known to modify the effect of the preferred platinum component. Such metal modifiers may include Group IVA (14) metals, other Group VIII (8–10) metals, rhenium, indium, gallium, zinc, uranium, dysprosium, thallium and mixtures thereof. Excellent results are obtained when the reforming catalyst contains a tin component. Catalytically effective amounts of such metal modifiers may be incorporated into the catalyst by any means known in the art.

The reforming catalyst may contain a halogen component. The halogen component may be either fluorine, chlorine, bromine or iodine or mixtures thereof. Chlorine is the preferred halogen component. The halogen component is generally present in a combined state with the inorganic-oxide support. The halogen component is preferably well dispersed throughout the catalyst and may comprise from more than 0.2 to about 15 wt. %. calculated on an elemental basis, of the final catalyst.

An optional ingredient of the reforming catalyst is an L-zeolite. It is within the ambit of the present invention that the same catalyst may be used in the first and second reforming zones. Since the sulfur content of the feedstock to the first reforming zone is at levels taught in the prior art while sulfur is substantially precluded from the feed to the second reforming zone, the optional reforming catalyst containing L-zeolite is less effective for the dehydrocyclization of paraffins than is the dehydrocyclization catalyst in the second reforming zone even if the catalysts have the same composition. In this option, therefore, the first reforming catalyst containing L-zeolite functions primarily to convert small amounts of sulfur in the feedstock to $H_2S$ while dehydrogenating naphthenes to aromatics.

The reforming catalyst generally will be dried at a temperature of from about 100° to 320° C. for about 0.5 to 24 hours, followed by oxidation at a temperature of about 300° to 550° C. in an air atmosphere for 0.5 to 10 hours. Preferably the oxidized catalyst is subjected to a substantially water free reduction step at a temperature of about 300° to 550° C. for 0.5 to 10 hours or more. Further details of the preparation and activation of embodiments of the reforming catalyst are disclosed in U.S. Pat. No. 4,677,094 (Moser et al.), which is incorporated into this specification by reference thereto.

The feed to each of the first reforming zone, sulfur-removal zone and second reforming zone may contact the respective catalyst system, sorbent or dehydrocyclization catalyst in each of the respective reactors in either upflow, downflow, or radial-flow mode. Since the present reforming process operates at relatively low pressure, the low pressure drop in a radial-flow reactor favors the radial-flow mode for a reactor containing a single zone; a downflow reactor is favored when the reactor contains multiple zones.

The catalyst or sorbent is contained in a fixed-bed reactor or in a moving-bed reactor whereby catalyst may be continuously withdrawn and added. These alternatives are associated with catalyst-regeneration options known to those of ordinary skill in the art, such as: (1) a semiregenerative unit containing fixed-bed reactors maintains operating severity by increasing temperature, eventually shutting the unit down for catalyst regeneration and reactivation; (2) a swing-reactor unit, in which individual fixed-bed reactors are serially isolated by manifolding arrangements as the catalyst become deactivated and the catalyst in the isolated reactor is regenerated and reactivated while the other reactors remain on-stream; (3) continuous regeneration of catalyst withdrawn from a moving-bed reactor, with reactivation and substitution of the reactivated catalyst, permitting higher operating severity by maintaining high catalyst activity through regeneration cycles of a few days; or: (4) a hybrid system with semiregenerative and continuous-regeneration provisions in the same unit. The preferred embodiment of the present invention is fixed-bed reactors in a semiregenerative unit.

Preferably about 75% to 95% of the total catalyst and sorbent volume of the process is represented by the dehydrocyclization catalyst. Continuous regeneration shows best results when applied to a large volume of catalyst, justifying the capital cost of the regeneration section. An optional embodiment therefore is a hybrid system with continuous regeneration of the dehydrocyclization catalyst. The first reforming catalyst and sulfur sorbent together thus preferably represent only about 5% to 25% of the total catalyst and sorbent volume of the process.

In an alternative embodiment, the first reforming zone containing the reforming catalyst and the sulfur-removal zone containing the physical mixture of reforming catalyst and sulfur sorbent are contained within the same reactor vessel. Savings are realized in piping, instrumentation and other appurtenances by employing a single reactor instead of two or more reactors to contain the first reforming and sulfur-removal zones. Preferably, the reactants contact the reforming catalyst and sulfur sorbent consecutively in a downflow manner. It is within the scope of the invention that a vapor, liquid, or mixed-phase stream is injected between the beds of particles to control the inlet temperature of the reactants to the sulfur sorbent.

Figure 2:
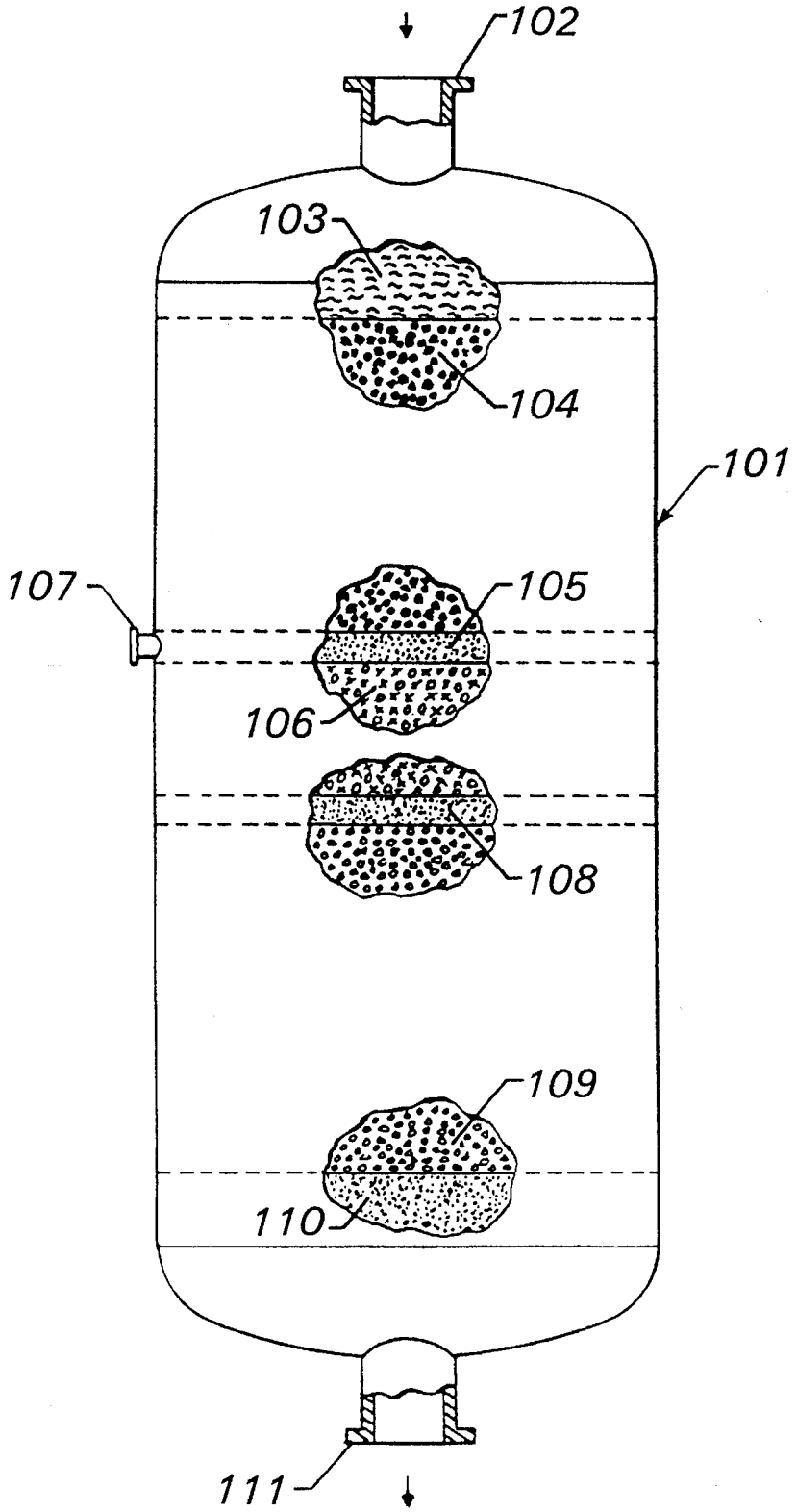
FIG. 2 shows a reactor comprising multiple zones which contain, respectively, the first reforming catalyst system, sulfur sorbent, and dehydrocyclization catalyst.

FIG. 2 is an elevational view illustrating an aspect of the above preferred embodiment as well as presenting optional embodiments of the invention; respective zone volumes are not intended to be to scale. A vertically oriented reactor vessel 101 contains the first reforming zone and sulfur-removal zone and, optionally, a portion of the second reforming zone. The combined feed enters the reactor vessel through nozzle 102 and contacts the catalyst system 104 comprising first reforming catalyst. Usually a screen, perforated device, and/or bed of inert particles 103 is placed above the catalyst system bed to improve flow distribution and prevent bed disruption from turbulence of the combined feed. First effluent from the catalyst system generally passes through a layer of inert support material 105, which serves to distribute the flow of hydrocarbons and hydrogen and separate zones to prevent mixing of particles, to sulfur-removal zone 106. The inert support material preferably is an inorganic oxide as described hereinabove, and especially alumina in either spherical or extruded form. Since the physical mixture comprising sulfur sorbent is provided in an amount sufficient principally to protect the downstream dehydrocyclization catalyst from sulfur surges, upsets or breakthroughs, the concentration of sulfur in the first effluent optimally is monitored on a regular basis by withdrawing a sample through sample tap 107 located at or near the layer of inert support material. Second effluent from the sulfur-removal zone preferably passes through a second layer of support material 108 to second reforming zone 109 containing the dehydrocyclization catalyst. Aromatics-rich effluent is withdrawn from the reactor through a bottom layer of support material 110 via nozzle 111. In the above optional embodiment, the first reforming zone, sulfur-removal zone and from about 5% to 30% of the second reforming zone are contained within the same reactor vessel. In yet another optional embodiment, the first reforming zone is contained in a separate vessel and the sulfur-removal zone and from about 5% to 30% of the second reforming zone are contained within the same reactor vessel.

In a preferred embodiment, the sequence of sulfur-removal zone and second reforming zone are repeated in one or more additional stages, i.e., an aromatics-enriched effluent from a reactor in the second reforming zone containing the dehydrocyclization catalyst is processed in another sequence of sulfur-removal zone followed by second reforming zone. Generally the reaction mixture is heated between stages to control reactor inlet temperature. The physical mixture of catalyst and sorbent in the sulfur-removal zone and the dehydrocyclization catalyst in the second reforming zone optimally are contained in the same reactor, with the mixture protecting each reactor load of dehydrocyclization catalyst from sulfur contamination. In an alternative embodiment, an organic sulfur compound is injected into the reactants to protect equipment, e.g. heater tubes, from coking prior to the sulfur-removal zone; such sulfur compounds may be but are not limited to thiophenes, mercaptans, sulfides and disulfides.

In an elective embodiment, the first reforming zone and sulfur-removal zone are contained as annular concentric zones within the same vertically oriented reactor vessel. Each zone is defined by two perforated cylindrical partitions coaxially disposed within the reactor vessel. The reforming catalyst and sulfur sorbent are retained within the respective zones by top and bottom closures disposed at the two ends of the perforated cylindrical partitions. The cylindrical partitions are perforated in a manner to retain the reforming catalyst and sulfur sorbent while permitting transfer of feed, reactants and associated gaseous materials through the partitions; one or more of the perforated cylindrical partitions may comprise a screen. The perforated cylindrical partitions also define an outer annular manifold and central manifold for distributing feed and reactants to and collecting reactants from the respective zones.

The sulfur-removal zone contains a physical mixture of a second reforming catalyst containing a platinum-group metal and a sulfur sorbent comprising a manganese component. This catalyst system has been found to be surprisingly effective, in comparison to the prior art in which the first reforming catalyst and sulfur sorbent are utilized in sequence, in removing sulfur from the hydrocarbon feedstock while effecting reforming in a combination emphasizing dehydrocyclization. The co-action of the catalyst and sorbent provides excellent results in achieving favorable yields with high catalyst utilization in a dehydrocyclization operation using a sulfur-sensitive catalyst.

First particles of reforming catalyst and second particles of sulfur sorbent are prepared as described hereinbelow. Preferably the first particles are essentially free of sulfur sorbent and the second particles are essentially free of reforming catalyst, and the first and second particles are mechanically mixed to provide the catalyst system of the invention. The particles can be thoroughly mixed using known techniques such as mulling to intimately blend the physical mixture. The mass ratio of reforming catalyst to sulfur sorbent depends primarily on the sulfur content of the feed, and may range from about 1:10 to 10:1. Preferably, a 100 cc sample of a contemporaneously mixed batch will not differ in the percentage of each component of the mixture relative to the batch by more than 10%. Although the first and second particles may be of similar size and shape, the particles preferably are of different size and/or density for ease of separation for purposes of regeneration or rejuvenation following their use in hydrocarbon processing.

As an alternative embodiment of the present invention, the physical mixture of conversion catalyst and sulfur sorbent is contained within the same catalyst particle. In this embodiment, the catalyst and sorbent may be ground or milled together or separately to form particles of suitable size, preferably less than 100 microns, and the particles are supported in a suitable matrix. Optimally the matrix is selected from the inorganic oxides described hereinabove.

The sulfur sorbent generally comprises a manganese component, preferably a manganese oxide. Manganese oxide has been found to provide reforming catalyst protection superior to the zinc oxide of the prior art, it is believed, due to possible zinc contamination of downstream reforming catalyst. The manganese oxides include MnO, $Mn_3O_4$, $Mn_2O_3$, $MnO_2$, $MnO_3$, and $Mn_2O_7$. The preferred manganese oxide is MnO (manganous oxide). The manganese component may be composited with a suitable binder such as clays, graphite, or inorganic oxides including one or more of alumina, silica, zirconia, magnesia, chromia or boria. Preferably, the manganese component is unbound and consists essentially of manganese oxide. Even more preferably the manganese component consists essentially of MnO, which has demonstrated excellent results for sulfur removal and has shown adequate particle strength without a binder for the present invention.

The manganese component is provided in an amount effective to preclude sulfur from the dehydrocyclization catalyst in the second reforming zone by providing a substantially sulfur-free second effluent from the sulfur sorbent based upon a feedstock to the first reforming zone as defined hereinabove. Sulfur-free is defined as containing less than 20 parts per billion (ppb), and preferably less than 14 ppb, sulfur. In another aspect, sulfur-free is defined as containing no detectable sulfur. The repeatability of the American National Standard test ASTM D 4045-87 is 20 ppb at a sulfur level of 0.02 ppm (20 ppb), and "sulfur free" according to this test therefore would be defined as less than 20 ppb sulfur. It is believed, however, that one laboratory testing a series of similar samples can detect differences at lower sulfur levels, e.g., 10 μg/ml or 14 ppb sulfur for the feedstocks described in the examples cited hereinafter. Such differences are reported in the examples.

The second reforming catalyst may be the same as the first reforming catalyst as described hereinabove or, preferably, is identical to the dehydrocyclization catalyst described hereinbelow. The sulfur sensitivity of each of the reforming catalyst and the dehydrocyclization catalysts is measured as a Sulfur-Sensitivity Index or "SSI." The SSI is a measure of the effect of sulfur in a hydrocarbon feedstock to a catalytic reforming process on catalyst performance, especially on catalyst activity.

The SSI is measured as the relative deactivation rate with and without sulfur in the feedstock for the processing of a hydrocarbon feedstock to achieve a defined conversion at defined operating conditions. Deactivation rate is expressed as the rate of operating temperature increase per unit of time (or, giving equivalent results, per unit of catalyst life) to maintain a given conversion; deactivation rate usually is measured from the time of initial operation when the unit reaches a steady state until the "end-of-run," when deactivation accelerates or operating temperature reaches an excessive level as known in the art. Conversion may be determined on the basis of product octane number, yield of a certain product, or, as here, feedstock disappearance. In the present application, deactivation rate at a typical feedstock sulfur content of 0.4 ppm (400 ppb) is compared to deactivation rate with a sulfur-free feedstock:

$SSI=D_s/D_o$ $D_s$=deactivation rate with 0.4 ppm sulfur in feedstock $D_o$=deactivation rate with sulfur-free feedstock "Sulfur-free" in this case means less than 50 ppb, and more usually less than 20 ppb, sulfur in the feedstock.

As a ratio, SSI would not be expected to show large variances with changes in operating conditions. The base operating conditions defining SSI in the present application are a pressure of about 4.5 atmospheres, liquid hourly space velocity (LHSV) of about 2, hydrogen to hydrocarbon molar ratio of about 3, and conversion of hexanes and heavier hydrocarbons in a raffinate from aromatics extraction as defined in the examples. Other conditions are related in the examples. Operating temperature is varied to achieve the defined conversion, with deactivation rate being determined by the rate of temperature increase to maintain conversion as defined above. A sulfur-sensitive catalyst has an SSI of over 1.2, and preferably at least about 2.0. Catalysts with an SSI of about three or more are particularly advantageously protected from sulfur deactivation according to the present invention.

Preferably a relatively small amount of the physical mixture is required for sulfur removal from a second effluent to the dehydrocyclization catalyst. The amount of the physical mixture generally is established in order to protect the dehydrocyclization catalyst from sulfur surges, upsets or breakthroughs, for example 1 mass ppm of sulfur in first effluent for a period of 24 hours. A shallow bed of the physical mixture is particularly effective in retrofitting existing units. Generally the thickness of the bed of the physical mixture is between about 10 and 100 cm, and more usually a maximum of about 30 cm. The resulting liquid hourly space velocity with respect to the physical mixture is from about 5 to 200 $hr^{-1}$, and preferably from about 10 to 100 $hr^{-1}$.

Operating conditions employed in the sulfur-removal zone containing the physical mixture to preclude sulfur from the second reforming zone include a pressure of from about atmospheric to 60 atmospheres (abs), with the preferred range being from atmospheric to 20 atmospheres (abs) and a pressure below 10 atmospheres being especially preferred. The hydrogen to hydrocarbon mole ratio is defined by the operation of the first reforming zone hereinabove, and is from about 0.1 to 10 moles of hydrogen per mole of hydrocarbon in the first effluent. Operating temperature may be controlled to be independent of the first reforming zone, as shown in FIG. 1. However, it is preferred that this temperature be defined by the temperature of the first effluent, and be within the range of from about 260° to 560° C. As the dehydrogenation of naphthenes in the first reforming zone normally will result in a decline in temperature across this zone due to the endothermic heat of reaction, the operating temperature of the sulfur-removal zone usually is lower than that of the first reforming zone. A temperature of from about 310° to 420° C. is especially preferred for the sulfur-removal zone.

The second reforming zone operates at a pressure, consistent with the first reforming and sulfur-removal zones, of from about atmospheric to 60 atmospheres (abs) and preferably from atmospheric to 20 atmospheres (abs). Excellent results have been obtained at operating pressures of less than 10 atmospheres. The hydrogen to hydrocarbon mole ratio is from about 0.1 to 10 moles of hydrogen per mole of $C_5$+ second effluent from the sulfur-removal zone. Space velocity with respect to the volume of dehydrocyclization catalyst is from about 0.2 to 10 $hr^{-1}$. Operating temperature is from about 400° to 560° C., and preferably is controlled independently of temperature in the sulfur-removal zone as indicated hereinabove and in FIG. 1.

Since the predominant reaction occurring in the second reforming zone is the dehydrocyclization of paraffins to aromatics, this zone comprises two or more reactors with interheating between reactors to compensate for the endothermic heat of reaction and maintain dehydrocyclization conditions. The second reforming zone thus will produce an aromatics-rich effluent stream, with the aromatics content of the $C_5$ + portion of the effluent typically within the range of about 45 to 85 mass %. The composition of the aromatics will depend principally on the feedstock composition and operating conditions, and generally will consist principally of $C_6$–$C_{12}$ aromatics. Benzene, toluene and $C_8$ aromatics will be the primary aromatics produced from the preferred light naphtha and raffinate feedstocks. It is within the scope of the invention that the physical mixture and dehydrogenation catalyst are layered within the second reforming zone, preferably with a protective layer of sorbent at the top of one or more reactors of the zone.

In one embodiment, a first effluent from the first reforming zone enters a reactor vessel containing the physical mixture as a downflow bed and the dehydrogenation catalyst as a radial-flow bed. Sulfur is removed from the first effluent by the sorbent; the amount of sulfur entering the reactor and remaining with the sulfur sorbent preferably is recorded and compared with the sulfur capacity of the sorbent.

The dehydrocyclization catalyst contains a non-acidic L-zeolite and a platinum group metal component. It is essential that the L-zeolite be non-acidic, as acidity in the zeolite lowers the selectivity to aromatics of the finished catalyst. In order to be "non-acidic," the zeolite has substantially all of its cationic exchange sites occupied by nonhydrogen species. Preferably the cations occupying the exchangeable cation sites will comprise one or more of the alkali metals, although other cationic species may be present. An especially preferred nonacidic L-zeolite is potassium-form L-zeolite.

It is necessary to composite the L-zeolite with a binder in order to provide a convenient form for use in the catalyst of the present invention. The art teaches that any refractory inorganic oxide binder is suitable. One or more of silica, alumina or magnesia are preferred binder materials of the present invention. Amorphous silica is especially preferred, and excellent results are obtained when using a synthetic white silica powder precipitated as ultra-fine spherical particles from a water solution. The silica binder preferably is nonacidic, contains less than 0.3 mass % sulfate salts, and has a BET surface area of from about 120 to 160 $m^2/g$.

The L-zeolite and binder may be composited to form the desired catalyst shape by any method known in the art. For example, potassium-form L-zeolite and amorphous silica may be commingled as a uniform powder blend prior to introduction of a peptizing agent. An aqueous solution comprising sodium hydroxide is added to form an extrudable dough. The dough preferably will have a moisture content of from 30 to 50 mass % in order to form extrudates having acceptable integrity to withstand direct calcination. The resulting dough is extruded through a suitably shaped and sized die to form extrudate particles, which are dried and calcined by known methods. Alternatively, spherical particles may be formed by methods described hereinabove for the reforming catalyst.

The platinum-group metal component is another essential feature of the dehydrocyclization catalyst, with a platinum component being preferred. The platinum may exist within the catalyst as a compound such as the oxide, sulfide, halide, or oxyhalide, in chemical combination with one or more other ingredients of the catalytic composite, or as an elemental metal. Best results are obtained when substantially all of the platinum exists in the catalytic composite in a reduced state. The platinum component generally comprises from about 0.05 to 5 mass % of the catalytic composite, preferably 0.05 to 2 mass %, calculated on an elemental basis.

It is within the scope of the present invention that the catalyst may contain other metal components known to modify the effect of the preferred platinum component. Such metal modifiers may include Group IVA(14) metals, Group VIIB(7) metals, other Group VIII(8–10) metals, rhenium, indium, gallium, zinc, uranium, dysprosium, thallium and mixtures thereof. Catalytically effective amounts of such metal modifiers may be incorporated into the catalyst by any means known in the art.

One or more of a non-noble Group VIII (8–10) metal, manganese, and rhenium are preferred among the optional metal modifiers, with nickel being especially preferred. Generally the metal modifier is present in a concentration of from about 0.01 to 5 mass % of the finished catalyst on an elemental basis, with a concentration of from about 0.05 to 2 mass % being preferred. The ratio of platinum-group metal to metal modifier is from about 0.2 to 20 on an elemental mass basis, and preferably is from about 0.5 to 10.

The metal modifier component is incorporated in the catalyst in any manner effective to minimize its presence in the pores of the non-acidic molecular sieve, i.e., to effect a pore-extrinsic metal modifier. A pore-extrinsic metal modifier is concentrated outside the pores of the molecular-sieve component of the catalyst. The concentration of pore-extrinsic metal in mass % on a binder component of the catalyst is higher than on the molecular-sieve component of the catalyst. Preferably the concentration of the metal modifier on the binder to concentration of the metal modifier on the molecular sieve is at least about 2.5, and more preferably the ratio is at least about 2. A dehydrocyclization catalyst containing a pore-extrinsic metal modifier has shown improved tolerance to sulfur compounds in the feedstock compared to catalysts of the prior art as measured by the aforementioned Sulfur-Sensitivity Index.

The final dehydrocyclization catalyst generally will be dried at a temperature of from about 100° to 320° C. for about 0.5 to 24 hours, followed by oxidation at a temperature of about 300° to 550° C. (preferably about 350° C.) in an air atmosphere for 0.5 to 10 hours. Preferably the oxidized catalyst is subjected to a substantially water-free reduction step at a temperature of about 300° to 550° C. (preferably about 350° C) for 0.5 to 10 hours or more. The duration of the reduction step should be only as long as necessary to reduce the platinum, in order to avoid pre-deactivation of the catalyst, and may be performed in-situ as part of the plant startup if a dry atmosphere is maintained. Further details of the preparation and activation of embodiments of the dehydrocyclization catalyst are disclosed, e.g., in U.S. Pat. Nos. 4,619,906 (Lambert et al) and 4,822,762 (Ellig et al.), which are incorporated into this specification by reference thereto.

Using techniques and equipment known in the art, the aromatics-containing effluent from the second reforming zone usually is passed through a cooling zone to a separation zone. In the separation zone, typically maintained at about 0° to 65° C., a hydrogen-rich gas is separated from a liquid phase. The resultant hydrogen-rich stream can then be recycled through suitable compressing means back to the first reforming zone. The liquid phase from the separation zone is normally withdrawn and processed in a fractionating system in order to adjust the concentration of light hydrocarbons and produce an aromatics-containing reformate product.

EXAMPLES

The following examples are presented to demonstrate the present invention and to illustrate certain specific embodiments thereof. These examples should not be construed to limit the scope of the invention as set forth in the claims. There are many possible other variations, as those of ordinary skill in the art will recognize, which are within the spirit of the invention.

Three parameters are especially useful in evaluating reforming process and catalyst performance, particularly in evaluating catalysts for dehydrocyclization of paraffins. "Activity" is a measure of the catalyst's ability to convert reactants at a specified set of reaction conditions. "Selectivity" is an indication of the catalyst's ability to produce a high yield of the desired product. "Stability" is a measure of the catalyst's ability to maintain its activity and selectivity over time.

The examples illustrate the effect especially on reforming catalyst stability of precluding sulfur in the manner disclosed in the present invention.

Example I

The capability of a combination of a reforming catalyst and an MnO sulfur sorbent in series to achieve a substantially sulfur-free effluent from a naphtha feedstock was determined.

The platinum-tin on alumina reforming catalyst used in this determination had the following composition in mass %:

| | |
|---|---|
| Pt | 0.38 |
| Sn | 0.30 |
| Cl | 1.06 |

The manganous oxide consisted essentially of MnO in spherical pellets with over 90% in the size range of 4–10 mesh. Equal volumes of reforming catalyst and MnO were loaded in series with the reforming catalyst above the MnO. The sulfur-removal capability of this combination was tested by processing a hydrotreated naphtha spiked with thiophene to obtain a sulfur concentration of about 2 mass parts per million (ppm) in the feed. The naphtha feed had the following additional characteristics:

| | | |
|---|---|---|
| Sp. gr. | | 0.7447 |
| ASTM D-86, °C.: | IBP | 80 |
| | 50% | 134 |
| | EP | 199 |

The naphtha was charged to the reactor in a downflow operation, thus contacting the reforming catalyst and MnO successively. Operating conditions were as follows:

| | |
|---|---|
| Pressure, atmospheres | 8 |
| Temperature, °C. | 371 |
| Hydrogen/hydrocarbon, mol | 3 |
| Liquid hourly space velocity, $hr^{-1}$ | *10 |

*On total loading of catalyst + MnO

Over the 13-day testing period, there was no detectable sulfur in the liquid or vapor products. Adjusting ASTM D4045 repeatability for laboratory experience, the product sulfur level was reported as less than 14 parts per billion (ppb). The combination of a platinum-tin-alumina catalyst ahead of a bed of manganous oxide thus was able to treat naphtha with a sulfur content higher than would be obtained by standard hydrotreating to yield a product containing no detectable sulfur.

Example II

The impact on a dehydrocyclization catalyst as described hereinabove of reducing the feed sulfur content to a nondetectable level, similar to that achieved in Example I, was assessed in comparison to a feed sulfur content according to the prior art.

The feed on which the comparison was based was a raffinate from a combination of catalytic reforming followed by aromatics extraction to recover benzene, toluene and $C_8$ aromatics. The characteristics of the feedstock were as follows:

| | | |
|---|---|---|
| Sp. gr. | | 0.689 |
| ASTM D-86, °C.: | IBP | 67 |
| | 50% | 82 |
| | EP | 118 |
| Mass % Paraffins | | 87.5 |
| Olefins | | 2.0 |
| Naphthenes | | 7.1 |
| Aromatics | | 3.4 |
| Sulfur, mass ppb | | 70 |

Catalytic reforming tests were performed on the above raffinate without and with high-surface sodium treatment for sulfur removal. The catalyst contained 1.07 mass % platinum on a base of 50/50 mass % L-zeolite and alumina. Operating conditions were as follows:

| | |
|---|---|
| Pressure, atmospheres | 5 |
| Hydrogen/hydrocarbon, mol | 5 |
| Liquid hourly space velocity, $hr^{-1}$ | 2.5 |

Figure 3:
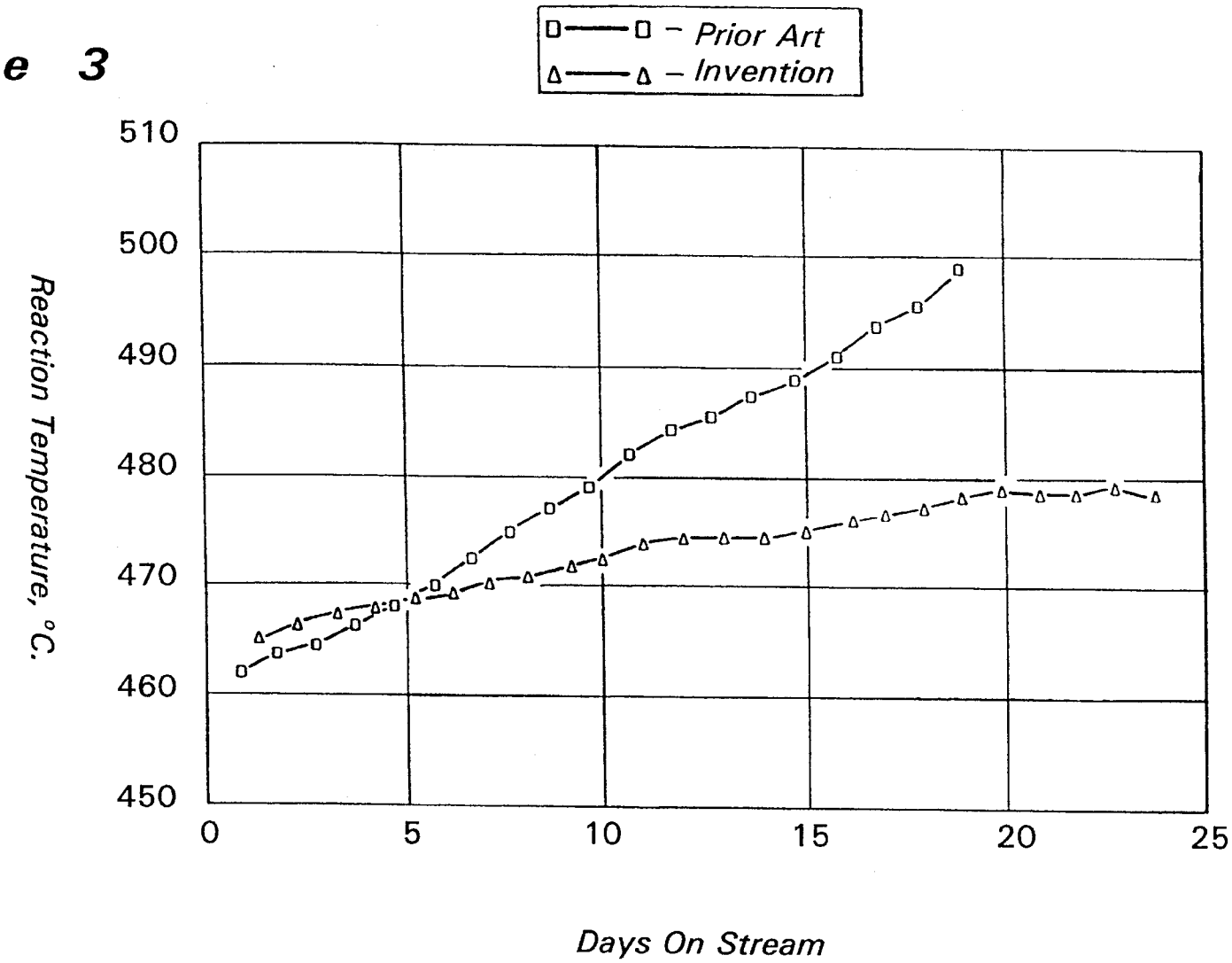
FIG. 3 is a graph of the temperature requirement to maintain 55% conversion of the feedstock of Example II in a reforming operation, comparing results based on preclusion of feed sulfur according to the present invention with results corresponding to the prior art.

Temperature was adjusted as required to achieve 55 mass % conversion of the charge stock to aromatics plus butane and lighter products, as shown in FIG. 3. The comparative results may be summarized as follows:

| | | |
|---|---|---|
| Feed sulfur content, ppb | 70 | <14 |
| Deactivation rate, °C./day | 2.0 | 0.7 |

Yields of aromatics and $C_5$+ product were essentially the same during the two runs, with the sulfur-free feed showing an advantage of about 0.3% in the late stages of the comparison runs. The aromatics content of the respective $C_5$+ products was approximately as follows:

| | | |
|---|---|---|
| Feed sulfur content, mass ppb | 70 | <14 |
| Aromatics in $C_5$+, mass % | | |
| Benzene | 15.0 | 16.0 |
| Toluene | 25.2 | 24.8 |
| $C_8$ aromatics | 8.6 | 8.2 |
| $C_{9+}$ aromatics | 0.1 | 0.1 |

Thus, the reforming catalyst stability with a sulfur-free feed was about three times better than when processing the same feed containing 70 parts per billion sulfur, and end-of-run yields were slightly improved with a sulfur-free feed.

Example III

The impact on dehydrocyclization catalyst life of the preclusion of sulfur from a feed with an already low sulfur level of 25 ppb was examined.

The feedstock was a light raffinate, from catalytic reforming followed by extraction of benzene and toluene, with the following characteristics:

| | | |
|---|---|---|
| Sp. gr. | | 0.682 |
| ASTM-D86, °C.: | IBP | 69 |
| | 50% | 78 |
| | EP | 103 |
| Mass % Paraffins | | 90.4 |
| Olefins | | 2.9 |
| Naphthenes | | 5.3 |
| Aromatics | | 1.4 |
| Sulfur, mass ppb | | 25 |

Catalytic reforming tests were performed on the above raffinate without and with high-surface sodium treatment for sulfur removal. The catalyst contained about 0.65 mass % platinum on a base of 85/15% L-zeolite and silica. Operating conditions were as follows:

| | |
|---|---|
| Pressure, atmospheres | 5 |
| Hydrogen/hydrocarbon, mol | 5 |
| liquid hourly space velocity, $hr^{-1}$ | 1.5 |

Figure 4:
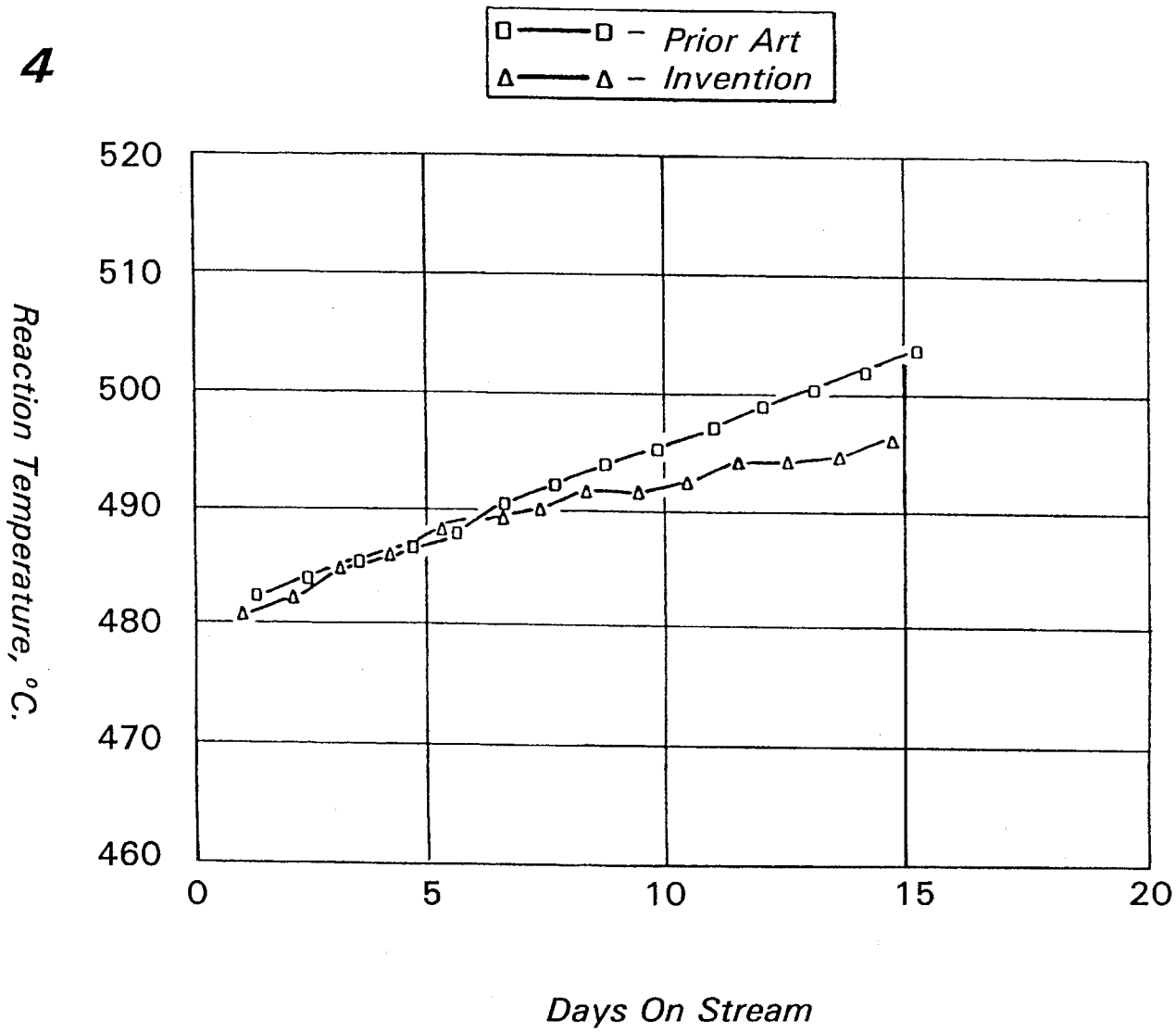
FIG. 4 is a graph of the temperature requirement to maintain 99 Research octane clear product when reforming the feed of Example III, comparing results based on preclusion of feed sulfur according to the present invention with results corresponding to the prior art.

Temperature was adjusted as required to produce 99 Research-octane-number $C_5$+ product, as shown in FIG. 4. The comparative results may be summarized as follows:

| | | |
|---|---|---|
| Feed sulfur content, ppb | 25 | <14 |
| Deactivation rate, °C./day | 2.6 | 1.9 |

Catalytic reforming of a sulfur-free feed thus demonstrated a significant improvement in deactivation rate, even in comparison to the processing of a feed with a feed sulfur content well below that taught in the prior art.

Example IV

The benefit of precluding sulfur from a straight-run naphtha feed to a dehydrocyclization catalyst as described hereinabove was studied.

The feed was a desulfurized light naphtha fraction, containing principally $C_6$ and $C_7$ hydrocarbons and having the following characteristics:

| | | |
|---|---|---|
| Sp. gr. | | 0.7152 |
| ASTM D-86, °C.: | IBP | 69 |
| | 50% | 79 |
| | EP | 141 |
| Mass % Paraffins | | 54.1 |
| | Naphthenes | 41.2 |
| | Aromatics | 4.7 |
| Sulfur, mass ppb | | 56 |

Catalytic reforming tests were performed on the above naphtha with and without high-surface sodium treatment for sulfur removal. The reforming catalyst contained about 1.07% platinum on a base of 50/50 mass % L-zeolite and silica. Operating conditions were as follows:

| | |
|---|---|
| Pressure, atmospheres | 5 |
| Hydrogen/hydrocarbon, mol | 5 |
| Liquid hourly space velocity, $hr^{-1}$ | 1.5 |

Figure 5:
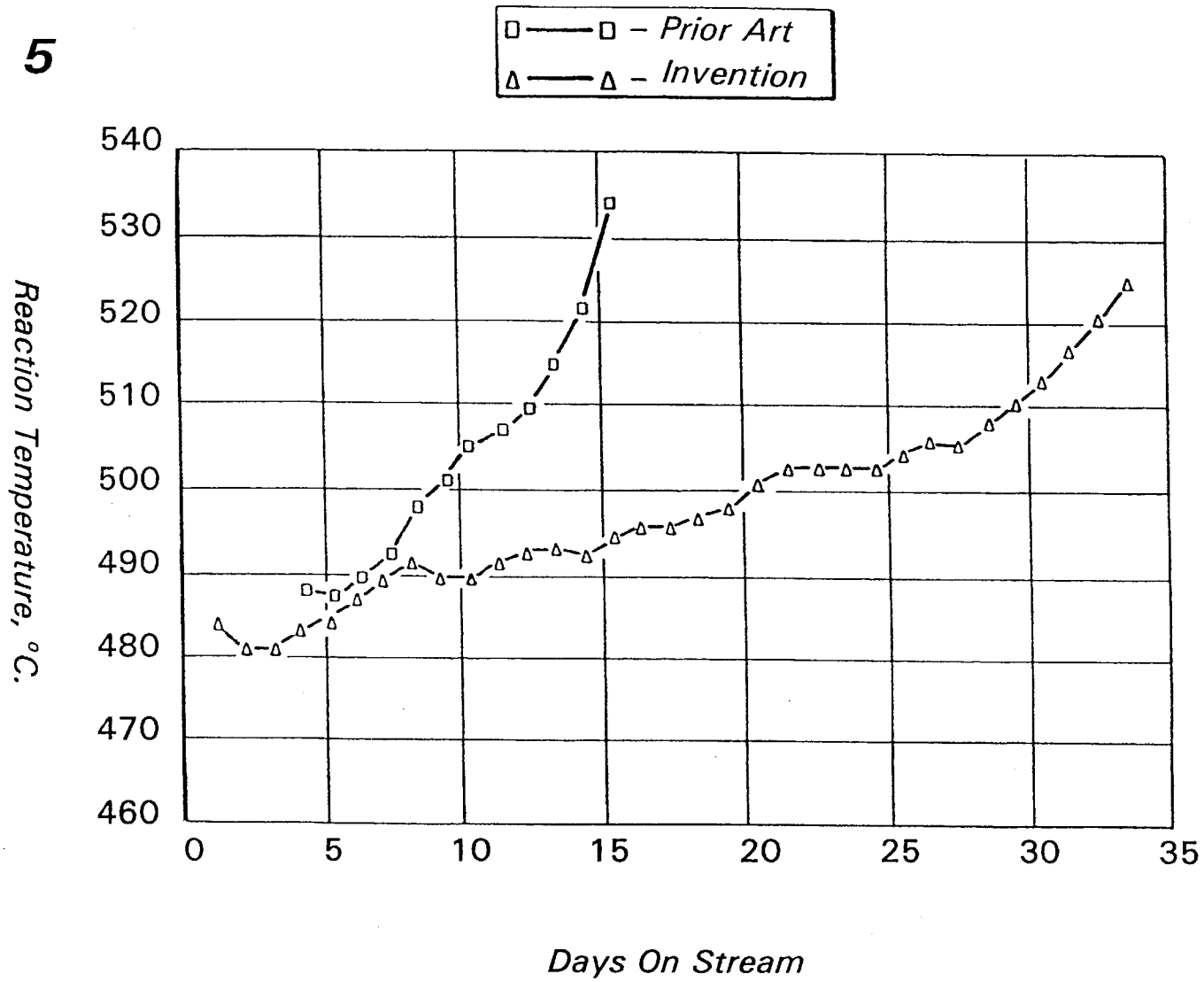
FIG. 5 is a graph of the temperature requirement to maintain 99 Research octane clear product when reforming the feed of Example IV, comparing results based on preclusion of feed sulfur according to the present invention with results corresponding to the prior art.

Temperature was adjusted as required to produce 99 Research-octane-number $C_{5+}$ product, as shown in FIG. 5. The comparative results may be summarized as follows:

| | | |
|---|---|---|
| Feed sulfur content, ppb | 56 | not detected |
| Deactivation rate, °C./day | 3.5 | 1.0 |

The sulfur-free feedstock thus provided a second-reforming-catalyst deactivation rate about 3.5 times lower in a reforming operation than the desulfurized feedstock containing only 56 ppb sulfur.

Reduction of sulfur content in the feed to a reforming catalyst as described hereinabove to levels well below those described in the prior art thus shows surprising benefits in catalyst stability in the catalytic reforming process of the present invention.

Example V

Having demonstrated the sulfur-removal capability of the manganese-oxide sorbent per Example I, the compatibility of the manganese sorbent in the process of the present invention was tested relative to the preferred zinc-oxide sorbent of the prior art. Zinc oxide is known from the prior art to be effective for sulfur removal. Thus, this example demonstrated whether any aspect of either metal oxide would affect the operation of the second reforming catalyst, precluding the known effect of sulfur removal by using a sulfur-free feedstock.

A reactor loading was prepared for the zinc-oxide test which contained a bed of zinc oxide pellets between two beds of reforming catalyst. The cylindrical, down-flow reactor containing the following three layers from top to bottom:

| Volume | Material |
|---|---|
| 20 cc | Reforming Catalyst |
| 40 cc | Zinc Oxide Pellets |

-continued

| Volume | Material |
|---|---|
| 80 cc | Reforming Catalyst |

The reforming catalyst contained about 1.1 mass-% platinum on a base of 50/50% L-zeolite and alumina. The zinc oxide was a commercially available desulfurization catalyst obtained from Katalco called "32-4".

For the manganese-oxide test, procedures were similar to those used for zinc oxide with a small variance in reactor loading. In place of the 40 cc of the zinc oxide, we loaded 30 cc of manganous oxide and 10 cc of alpha-alumina pellets. Alumina is known to be inert for sulfur removal or reforming at the Conditions employed. The manganous oxide consisted essentially of MnO in spheroidal pellets with over 90% in the size range of 4–10 mesh.

The feedstock to both tests was identical to that employed in Example II, with high-surface-sodium removal of sulfur in order to isolate the impact of incompatibility on the process. Operating conditions in both cases were as follows:

| | |
|---|---|
| Pressure, psig | 60 |
| Hydrogen/Hydrocarbon, moles | 2 |
| Liquid Hourly Space Velocity, $hr^{-1}$ | 1.5 |

Temperature was adjusted as required to achieve 70% conversion of the non-aromatics contained in the feed to either aromatics or cracked products (pentane or lighter hydrocarbons). No chloride was added during the test.

Figure 6:
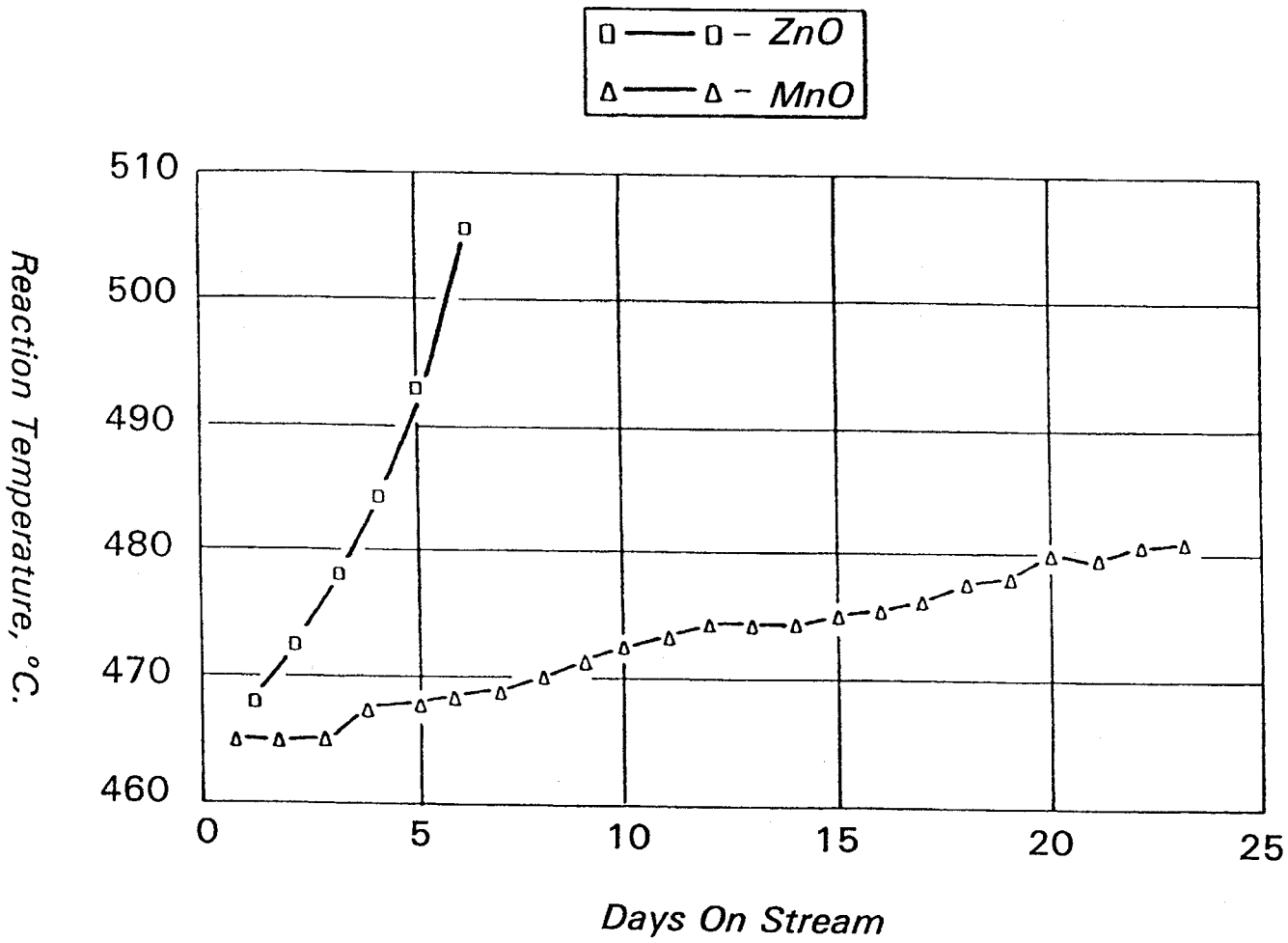
FIG. 6 shows the relative compatibility of zinc oxide and manganese oxide to the second reforming catalyst in distinguishing the process of the invention.

FIG. 6 provides test results, showing the rapid loss in activity of the reforming catalyst associated with zinc oxide. Catalyst deactivation was significantly lower with the loading of manganous oxide. Comparison to the deactivation with ZnO is noted below:

| Material | Deactivation (°C./day) |
|---|---|
| ZnO | >7 |
| MnO | 0.8 |

Example VI

Tests were performed to determine whether chloride present in platinum/L-zeolite catalysts, characterizing the second reforming catalyst, would result in the presence of chloride in reforming reactants. Three different catalysts, two with usual chloride levels and one with a high chloride content, were tested. The feedstock to the tests was a paraffinic raffinate, and operating conditions were consistent with those in previous examples.

Dreager tubes were used in the detection of chloride in the reactor off-gas stream. Hydrochloric acid and chlorine tubes both were employed, as indicated below, with respective ranges of 0.0 to 10.0 ppm and 0.0 to 3.0 ppm. Results were as follows:

| Test | Catalyst: | Cl. mass % | $Cl_2$ or HCl, ppm |
|---|---|---|---|
| 1 | A | 0.40 | 0.0 $Cl_2$ |
| 2 | A | 0.40 | 0.0 $Cl_2$ |
| 3 | B | 1.09 | 0.0 HCl |
| 4 | C | 0.38 | 0.0 HCl |
| 5 | C | 0.38 | 0.0 HCl |

-continued

| Test | Catalyst: | Cl. mass % | $Cl_2$ or HCl, ppm |
|---|---|---|---|
| 6 | C | 0.38 | 0.0 HCl |

These results indicate that there was no chloride present in the reforming reactants using platinum/L-zeolite catalyst, notwithstanding the chloride content of the catalysts.

Example VII

The performance of a mixture of a sulfur-sensitive dehydrocyclization catalyst and a sulfur sorbent when processing a feedstock containing a significant concentration of sulfur was assessed in a pilot-plant test.

The dehydrocyclization catalyst comprised platinum on silica-bound L-zeolite as described hereinabove, and the sulfur sorbent was manganous oxide. The catalyst and sorbent were mixed in a 50/50 ratio by volume. The tests were performed using a feedstock as described in Example II which was spiked with sulfur to effect a sulfur content of 3 mass ppm (3000 ppb). Operating conditions were as follows:

| | |
|---|---|
| Pressure, atmospheres | 5 |
| Hydrogen/hydrocarbon, mol | 3.5 |
| Liquid hourly space velocity, $hr^{-1}$ | 2 |

Temperature was adjusted as required to achieve 85 mass % conversion of the charge stock to aromatics plus butane and lighter products. Over the testing period of approximately 18 days, the yield of $C_5$+ product averaged about 86.5 mass %. Catalyst stability was compared to results when processing a feedstock containing 270 mass ppb, or less than 10% of the sulfur content of this test, using an unprotected dehydrocyclization catalyst at 55% conversion. The comparative results may be summarized as follows:

| | Mixed | Catalyst Only |
|---|---|---|
| Feed sulfur content, ppb | 3000 | 270 |
| Deactivation rate, °C./day | 2.0 | 5.5 |

The mixed system thus demonstrated well under half of the deactivation rate with a feed sulfur content of over ten times that of the test on the unprotected catalyst.

Example VIII

The advantage of the catalyst system of the invention in comparison to the prior art is illustrated via the comparative processing of 1000 metric tons per day of naphtha containing 0.5 mass ppm sulfur as thiophene.

Equal volumes of a conversion catalyst and a sulfur sorbent are loaded in reactors to achieve an overall liquid hourly space velocity of about 5 for both the illustration of the invention and the comparative case of the prior art. The catalyst and sorbent are physically mixed to illustrate the invention, and the conversion catalyst is loaded above the sulfur sorbent to illustrate the prior art. The relative quantities of catalyst and sorbent are as follows:

| | |
|---|---|
| Conversion catalyst | 4.8 tons |
| Sulfur sorbent | 9.6 tons |

The conversion catalyst is a sulfur-sensitive reforming catalyst as described hereinabove which suffers a rapid decline in dehydrocyclization capability in the presence of sulfur but retains capability for sulfur conversion up to its sulfur capacity, which is about 0.1 mass %. The conversion catalyst contains platinum on silica-bound potassium-form L-zeolite.

The sulfur sorbent is essentially pure manganous oxide, with a sulfur capacity of about 5 mass %.

The days of operation until full sulfur loading is achieved illustrates the advantage of the invention:

| | |
|---|---|
| Invention: | 970 days |
| Prior art | 9.6 days |

Example IX

The Sulfur-Sensitivity Index of a reforming catalyst of the prior art was determined. The extruded platinum-rhenium on chlorided alumina reforming catalyst used in this determination was designated Catalyst A and contained 0.25 mass % platinum and 0.40 mass % rhenium.

The SSI of this catalyst was tested by processing a hydrotreated naphtha in two comparative pilot-plant runs, one in which the naphtha was substantially sulfur-free and a second in which the naphtha was sulfur-spiked with thiophene to obtain a sulfur concentration of about 0.4 mass parts per million (ppm) in the feed. The naphtha feed had the following characteristics:

| | | |
|---|---|---|
| Sp. gr. | | 0.746 |
| ASTM D-86, °C.: | IBP | 85 |
| | 50% | 134 |
| | EP | 193 |

The naphtha was charged to the reactor in a downflow operation, with operating conditions as follows:

| | |
|---|---|
| Pressure, atmospheres | 15 |
| Hydrogen/hydrocarbon, mol | 2 |
| Liquid hourly space velocity, $hr^{-1}$ | 2.5 |

Target octane number was 98.0 Research Clear. The tests were carried out to an end-of-run temperature of about 535° C.

The Sulfur-Sensitivity Index was calculated on the basis of the relative deactivation rates with and without 0.4 ppm sulfur in the feed. Within the precision of the test, the deactivation rates were the same with and without sulfur in the feed at 3.0° C./day, and the SSI for Catalyst A therefore was 1.0. Catalyst A therefore represents a control catalyst of the prior art with respect to Sulfur-Sensitivity Index.

Example X

The Sulfur-Sensitivity Index of a second non-zeolitic reforming catalyst was determined. The spherical platinum-rhenium on chlorided alumina reforming catalyst used in this determination was designated Catalyst B and contained 0.22 mass % platinum and 0.44 mass % rhenium.

The SSI of this catalyst was tested by processing hydrotreated naphtha in two sets of comparative pilot-plant runs, one each in which the naphtha was substantially sulfur-free (Runs B-1 and B-1') and one each in which the naphtha was sulfur-spiked with thiophene (Runs B-2 and B-2') to obtain a sulfur concentration of about 0.4 mass parts per million (ppm) in the feed. The naphtha feed differed in each of the sets of runs and had the following characteristics:

| | | B-1, B-2 | B-1', B-2' |
|---|---|---|---|
| Sp. gr. | | 0.746 | 0.744 |
| ASTM D-86, °C.: | IBP | 85 | 79 |
| | 50% | 134 | 130 |
| | EP | 193 | 204 |

The naphtha was charged to the reactor in a downflow operation, with operating conditions as follows:

| | B-1, B-2 | B-1', B-2' |
|---|---|---|
| Pressure, atmospheres | 15 | 18 |
| Hydrogen/hydrocarbon, mol | 2 | 2 |
| Liquid hourly space velocity, $hr^{-1}$ | 2.5 | 2.5 |

Target octane number was 98.0 Research Clear. The tests were carried out to an end-of-run temperature of about 535° C.

The Sulfur-Sensitivity Index was calculated on the basis of the relative deactivation rates with and without 0.4 ppm sulfur in the feed, with the following results:

| | |
|---|---|
| B-1 | 1.6° C./day |
| B-2 | 2.5° C./day |
| SSI = B-2/B-1 = | 1.6 |
| B-1' | 0.85° C./day |
| B-2' | 1.1° C./day |
| SSI = B-2'/B-1' = | 1.3 |

Example XI

The Sulfur-Sensitivity Index of a highly sulfur-sensitive reforming catalyst was determined. The silica-bound potassium-form L-zeolite reforming catalyst used in this determination was designated Catalyst C and contained 0.82 mass % platinum.

The SSI of this catalyst was tested by processing a hydrotreated naphtha in two comparative pilot-plant runs, one in which the naphtha was substantially sulfur-free (Run C-1) and a second in which the naphtha was sulfur-spiked with thiophene to obtain a sulfur concentration of about 0.4 mass parts per million (ppm) in the feed (Run C-2). The naphtha feed had the following additional characteristics:

| | | |
|---|---|---|
| Sp. gr. | | 0.6896 |
| ASTM D-86, °C.: | IBP | 70 |
| | 50% | 86 |
| | EP | 138 |

The naphtha was charged to the reactor in a downflow operation, with operating conditions as follows:

| | |
|---|---|
| Pressure, atmospheres | 4.5 |
| Hydrogen/hydrocarbon, mol | 3 |
| Liquid hourly space velocity, $hr^{-1}$ | 2 |

The tests were carried out to an end-of-run temperature of about 480° C.

The Sulfur-Sensitivity Index was calculated on the basis of the relative deactivation rates with and without 0.4 ppm sulfur in the feed, with the following results:

| | |
|---|---|
| C-1 | 0.3° C./day |
| C-2 | 4.0° C./day |
| SSI = C-2/C-1 = | 13 |

We claim:

1. A process for the catalytic reforming of a hydrocarbon feedstock comprising a combination of:

(a) contacting a combined feed comprising the hydrocarbon feedstock and free hydrogen in the absence of added halogen in a first reforming zone at first reforming conditions comprising a pressure of from atmospheric to 20 atmospheres, a temperature of from 260° to 560° C., a liquid hourly space velocity of from about 1 to 40 $hr^{-1}$, and a hydrogen to hydrocarbon ratio of from about 0.1 to 10 moles of hydrogen per mole of hydrocarbon with a first reforming catalyst comprising platinum and alumina to convert sulfur compounds in the hydrocarbon feedstock to hydrogen sulfide and produce a first effluent;

(b) contacting the first effluent in the absence of added halogen in a sulfur-removal zone at sulfur-removal conditions comprising a pressure of from atmospheric to 20 atmospheres, a temperature of from 260° to 560° C., a liquid hourly space velocity of from about 5 to 200 $hr^{-1}$, and a hydrogen to hydrocarbon ratio of from about 0.1 to 10 moles of hydrogen per mole of hydrocarbon with a physical mixture of a second reforming catalyst containing a platinum-group metal component and a solid sulfur sorbent comprising a manganese component to remove hydrogen sulfide and produce a halogen-free second effluent containing less than 20 parts per billion sulfur; and, (c) contacting the second effluent in a second reforming zone in the presence of free hydrogen and in the absence of added halogen at second reforming conditions comprising a pressure of from atmospheric to 20 atmospheres, a temperature of from 425° to 560° C., a liquid hourly space velocity of from about 1 to 10 $hr^{-1}$, and a hydrogen to hydrocarbon ratio of from about 0.1 to 10 moles of hydrogen per mole of hydrocarbon with a dehydrocyclization catalyst comprising a non-acidic L-zeolite and a platinum-group metal component to produce a halogen-free aromatics-rich effluent.

2. The process of claim 1 wherein the hydrocarbon feedstock comprises a naphtha with a final boiling point of from about 100° to 160° C.

3. The process of claim 1 wherein the hydrocarbon feedstock comprises a raffinate from aromatics extraction.

4. The process of claim 1 wherein each of the first reforming conditions, sulfur-removal conditions and second reforming conditions comprise a pressure of below 10 atmospheres.

5. The process of claim 1 wherein the second reforming catalyst is the dehydrocyclization catalyst of step (c).

6. The process of claim 1 wherein the manganese component comprises one or more manganese oxides.

7. The process of claim 1 wherein the manganese component consists essentially of one or more manganese oxides.

8. The process of claim 1 wherein the physical mixture of second reforming catalyst and solid sulfur sorbent is contained within the same catalyst particle.

9. The process of claim 1 wherein the dehydrocyclization catalyst comprises an alkali-metal component.

10. The process of claim 1 wherein the non-acidic L-zeolite comprises potassiumform L-zeolite.

11. The process of claim 1 wherein the dehydrocyclization catalyst further comprises a pore-extrinsic nickel component.

12. A process for the catalytic reforming of a hydrocarbon feedstock comprising a combination of:

(a) contacting a combined feed comprising the hydrocarbon feedstock and free hydrogen in the absence of added halogen in a first reforming zone at first reforming conditions comprising a pressure of from atmospheric to 20 atmospheres, a temperature of from 260° to 560° C., a liquid hourly space velocity of from about 1 to 40 $hr^{-1}$, and a hydrogen to hydrocarbon ratio of from about 0.1 to 10 moles of hydrogen per mole of hydrocarbon with a first reforming catalyst comprising platinum and alumina to convert sulfur compounds in the hydrocarbon feedstock to hydrogen sulfide and produce a first effluent;

(b) contacting the first effluent in the absence of added halogen in a sulfur-removal zone at sulfur-removal conditions comprising a pressure of from atmospheric to 20 atmospheres, a temperature of from 260° to 560° C., a liquid hourly space velocity of from about 5 to 200 $hr^{-1}$, and a hydrogen to hydrocarbon ratio of from about 0.1 to 10 moles of hydrogen per mole of hydrocarbon with a physical mixture of a dehydrocyclization catalyst comprising a non-acidic L-zeolite and a platinum-group metal component and a solid sulfur sorbent comprising a manganese component to remove hydrogen sulfide and produce a halogen-free second effluent containing less than 20 parts per billion sulfur; and, (c) contacting the second effluent in a second reforming zone in the presence of free hydrogen and in the absence of added halogen at second reforming conditions comprising a pressure of from atmospheric to 20 atmospheres, a temperature of from 425° to 560° C., a liquid hourly space velocity of from about 1 to 10 $hr^{-1}$, and a hydrogen to hydrocarbon ratio of from about 0.1 to 10 moles of hydrogen per mole of hydrocarbon with the dehydrooyclization catalyst comprising a non-acidic L-zeolite and a platinum group metal component to produce a halogen-free aromatics-rich effluent.

13. The process of claim 12 wherein the physical mixture of dehydrocyclization catalyst and solid sulfur sorbent is contained within the same catalyst particle.

14. The process of claim 12 wherein the dehydrocyclization catalyst comprises an alkali-metal component.

15. The process of claim 12 wherein the non-acidic L-zeolite comprises potassium-form L-zeolite.

16. The process of claim 12 wherein the dehydrocyclization catalyst has a Sulfur-Sensitivity Index of at least about 1.2.

17. A process for the catalytic reforming of a hydrocarbon feedstock comprising a combination of:

(a) contacting a combined feed comprising the hydrocarbon feedstock and free hydrogen in the absence of added halogen in a first reforming zone at first reforming conditions comprising a pressure of from atmospheric to 20 atmospheres, a temperature of from 260° to 560° C., a liquid hourly space velocity of from about 1 to 40 $hr^{-1}$, and a hydrogen to hydrocarbon ratio of from about 0.1 to 10 moles of hydrogen per mole of hydrocarbon with a first reforming catalyst comprising platinum and alumina to convert sulfur compounds in the hydrocarbon feedstock to hydrogen sulfide and produce a first effluent;

(b) contacting the first effluent in the absence of added halogen in a sulfur-removal zone at sulfur-removal conditions comprising a pressure of from atmospheric to 20 atmospheres, a temperature of from 260° to 560° C., a liquid hourly space velocity of from about 5 to 200 $hr^{-1}$, and a hydrogen to hydrocarbon ratio of from about 0.1 to 10 moles of hydrogen per mole of hydrocarbon with a physical mixture of a dehydrocyclization catalyst comprising a non-acidic L-zeolite and a platinum-group metal component and a solid sulfur sorbent comprising a manganese component to remove hydrogen sulfide and produce a halogen-free second effluent containing less than 20 parts per billion sulfur;

(c) contacting the second effluent in a second reforming zone in the presence of free hydrogen and in the absence of added halogen at second reforming conditions comprising a pressure of from atmospheric to 20 atmospheres, a temperature of from 425° to 560° C., a liquid hourly space velocity of from about 1 to 10 $hr^{-1}$, and a hydrogen to hydrocarbon ratio of from about 0.1 to 10 moles of hydrogen per mole of hydrocarbon with the dehydrocyclization catalyst comprising potassium-form L-zeolite and a platinum group metal component to produce a halogen-free aromatics-enriched effluent; and, (d) repeating the sequential contact of the effluent from step (c) in one or more stages of a (b) sulfur-removal zone and a (c) second reforming zone to produce a halogen-free aromatics-rich effluent.

18. The process of claim 17 wherein one or more of the stages of sequential step (b) sulfur-removal zone and (c) second reforming zone are contained within the same reactor vessel.

19. The process of claim 18 wherein an organic sulfur compound is injected into the aromatics-enriched effluent entering one or more stages of the sequential step.

20. A process for the catalytic reforming of a contaminated feedstock comprising a combination of:

(a) contacting the contaminated feedstock in a sorbent pretreating step with a nickel sorbent at a pressure of from atmospheric to 50 atmospheres, a temperature of from about 70° to 200° C., and a liquid hourly space velocity of from about 2 to 50 $hr^{-1}$ to produce a low-sulfur hydrocarbon feedstock;

(b) contacting a combined feed comprising the hydrocarbon feedstock and free hydrogen in a first reforming zone at first reforming conditions comprising a pressure of from atmospheric to 20 atmospheres, a temperature of from 260° to 560° C., a liquid hourly space velocity of from about 1 to 40 $hr^{-1}$, and a hydrogen to hydrocarbon ratio of from about 0.1 to 10 moles of hydrogen per mole of hydrocarbon with a first reforming catalyst comprising platinum and alumina to convert sulfur compounds in the hydrocarbon feedstock to hydrogen sulfide and produce a first effluent;

(c) contacting the first effluent in the absence of added halogen in a sulfur-removal zone at sulfur-removal conditions comprising a pressure of from atmospheric to 20 atmospheres, a temperature of from 260° to 560° C., a liquid hourly space velocity of from about 5 to 200 $hr^{-1}$, and a hydrogen to hydrocarbon ratio of from about 0.1 to 10 moles of hydrogen per mole of hydrocarbon with a physical mixture of a dehydrocyclization catalyst comprising a non-acidic L-zeolite and a platinum-group metal component and a solid sulfur sorbent comprising a manganese component to remove hydrogen sulfide and produce a halogen-free second effluent containing less than 20 parts per billion sulfur; and, (d) contacting the second effluent in a second reforming zone in the presence of free hydrogen and in the absence of added halogen at second reforming conditions comprising a pressure of from atmospheric to 20 atmospheres, a temperature of from 425° to 560° C., a liquid hourly space velocity of from about 1 to 10 $hr^{-1}$, and a hydrogen to hydrocarbon ratio of from about 0.1 to 10 moles of hydrogen per mole of hydrocarbon with a dehydrocyclization catalyst comprising potassium-form L-zeolite and a platinum group metal component to produce a halogen-free aromatics-rich effluent.

* * * * *